US012115576B2

(12) United States Patent
Kalliokoski et al.

(10) Patent No.: US 12,115,576 B2
(45) Date of Patent: Oct. 15, 2024

(54) PROCESS OF PRODUCING A NON-FERROUS METALLIC TUBE

(71) Applicant: Upcast Oy, Pori (FI)

(72) Inventors: Juho Kalliokoski, Ulvila (FI); Hanna-Leena Suviniemi-Mäkitalo, Säkylä (FI); Jukka Lähteenmäki, Pori (FI)

(73) Assignee: Upcast Oy, Pori (FI)

( * ) Notice: Subject to any disclaimer, the term of this patent is extended or adjusted under 35 U.S.C. 154(b) by 102 days.

(21) Appl. No.: 17/906,666

(22) PCT Filed: Mar. 12, 2021

(86) PCT No.: PCT/FI2021/050181

§ 371 (c)(1),
(2) Date: Sep. 19, 2022

(87) PCT Pub. No.: WO2021/186105

PCT Pub. Date: Sep. 23, 2021

(65) Prior Publication Data

US 2023/0356291 A1 Nov. 9, 2023

(30) Foreign Application Priority Data

Mar. 19, 2020 (FI) ..... 20205279

(51) Int. Cl.

| | |
|---|---|
| ***B22D 11/14*** | (2006.01) |
| ***B22D 11/00*** | (2006.01) |
| ***B22D 21/02*** | (2006.01) |

(52) U.S. Cl.

CPC ..... *B22D 11/145* (2013.01); *B22D 11/004* (2013.01); *B22D 11/006* (2013.01); *B22D 21/025* (2013.01)

(58) Field of Classification Search

CPC ... B22D 11/145; B22D 11/004; B22D 11/006; B22D 21/025

See application file for complete search history.

(56) References Cited

U.S. PATENT DOCUMENTS

| | | | |
|---|---|---|---|
| 3,872,913 | A | 3/1975 | Lohikoski |
| 2018/0117650 | A1 | 5/2018 | Felberbaum et al. |
| 2019/0344318 | A1 | 11/2019 | Nakaura et al. |

FOREIGN PATENT DOCUMENTS

| | | | |
|---|---|---|---|
| EP | 1649950 | A2 | 4/2006 |
| EP | 2055795 | A2 | 5/2009 |

(Continued)

OTHER PUBLICATIONS

International Search Report and Written Opinion, in connection with International Application No. PCT/FI2021/050181, dated May 21, 2021.

(Continued)

*Primary Examiner* — Kevin P Kerns
*Assistant Examiner* — Steven S Ha
(74) *Attorney, Agent, or Firm* — Meunier Carlin & Curfman LLC

(57) ABSTRACT

The invention relates to a process of producing a non-ferrous metallic tube, in which process comprises a casting stage, in which a cast tube having an outer diameter of 20-70 mm, preferably 35-55 mm and a wall thickness of 1.0-4.0 mm, preferably 2.0-3.0 mm, is casted from melt by continuous upward vertical casting process, and the casting stage is followed by at least two drawing stages. In the drawing stages drawing direction of the cast tube in at least two each other following drawing stages is opposite to each other.

13 Claims, 2 Drawing Sheets

(56) References Cited

FOREIGN PATENT DOCUMENTS

| | | | |
|---|---|---|---|
| EP | 2803423 | A1 | 11/2014 |
| EP | 3057725 | B1 | 8/2017 |

OTHER PUBLICATIONS

Finnish Search Report, in connection with Finnish Application No. FI 20205279, dated Oct. 12, 2020.

Bigham Kevin J: "Turning Polymers into Possibilities Drawn Fiber Polymers: Chemical and Mechanical Features" (Dec. 31, 2018), URL:https://www.zeusinc.com/wp-content/uploads/2018/05/DrawnFiber-Tech-Paper-Zeus.pdf, [retrieved Dec. 8, 2021].

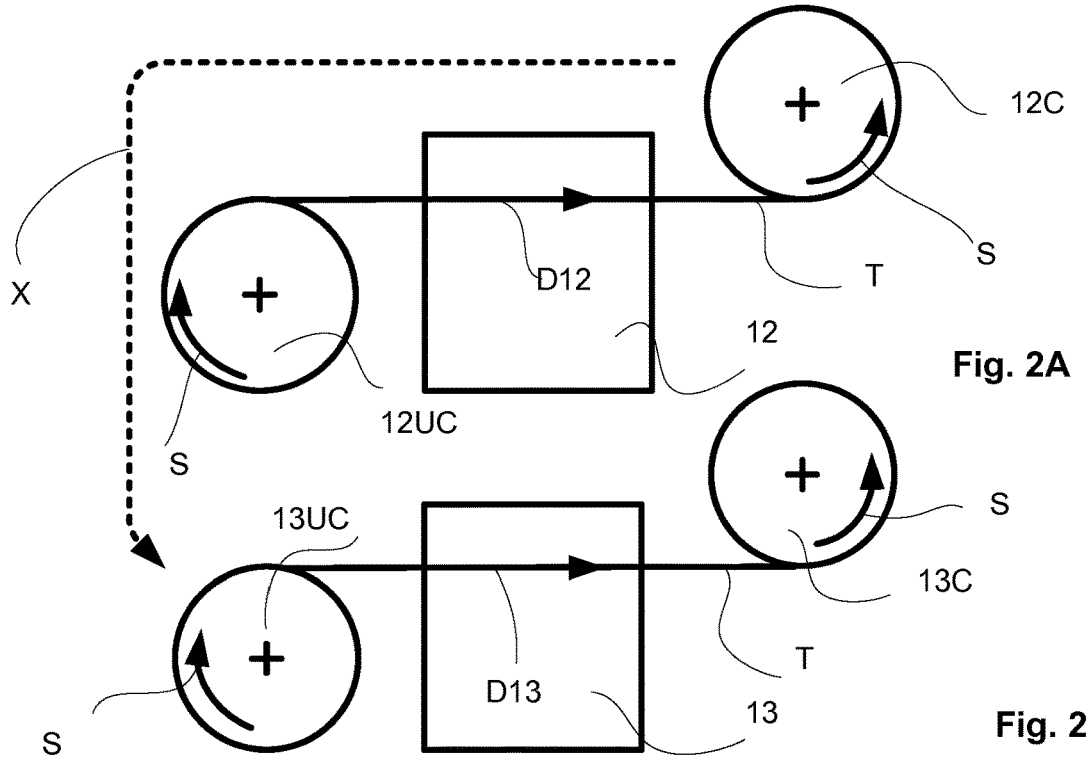
Fig. 2A
Fig. 2B
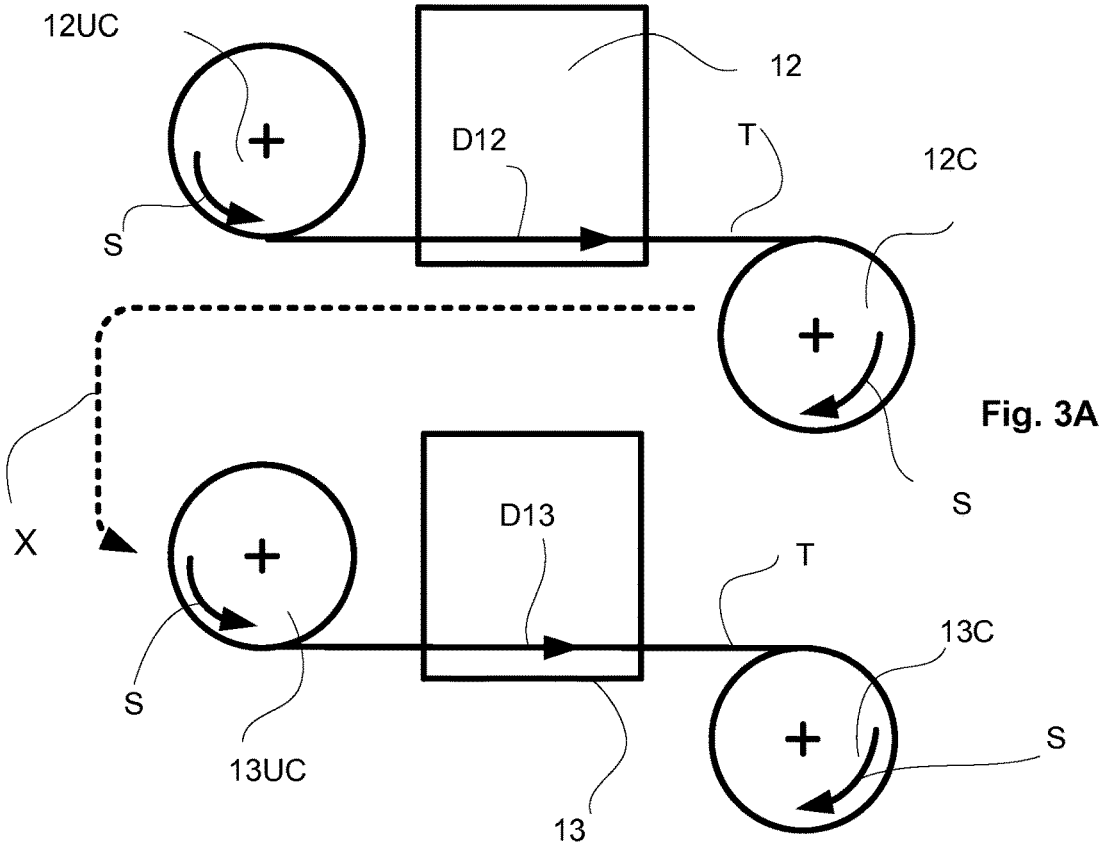
Fig. 3A
Fig. 3B

PROCESS OF PRODUCING A NON-FERROUS METALLIC TUBE

FIELD OF THE INVENTION

The invention relates to processes of producing a non-ferrous metallic tube. Especially the invention relates to a process of producing a non-ferrous metallic tube according to the claims.

BACKGROUND OF THE INVENTION

The most traditional tube manufacturing process involves first melting and casting a billet, preheating and extruding the billet, followed by Pilger rolling. An alternative is a Cast & Roll process, which involves melting of metal and horizontal casting a thick-walled tube, followed by machining the tube surface and planetary milling. These are highly complicated and hard-to-control processes.

A traditional arrangement for casting a tube in continuous casting directed upwards from a free melt surface is disclosed for example in patent publication U.S. Pat. No. 3,872,913, which discloses a method and apparatus for the upwards casting of profiled products, wherein melt is solidified by means of a nozzle (a die-cooler assembly), establishing a mold above its surface and having its lower end immersed in the melt thus creating a metallostatic pressure in the nozzle, and being connected at its upper end by way of a cooler-surrounded tube to a cooler support and a motorized withdrawal roll system, which executes a predefined program and pulls the cast tube upwards, through the nozzle. The cooler consists of three concentric tubes, between which extend cylindrical channels for cooling water. The innermost tube has a cross-section larger than that of the profiled tube. The nozzle is constructed in a single piece of refractory material and extends by its upper end coaxially into the cooler. The cooler support has an opening that matches a tube to be cast and, as the cooler is connected with a further cooling zone more extensive than this, said withdrawal system pulls the cast profile into the cooling zone present within the coolers.

In European patent publication EP 3057725 B1 is disclosed a continuous casting nozzle assembly for upward vertical casting of a non-ferrous tube, which is suitable for uninterrupted casting, which nozzle assembly comprises a nozzle, a mandrel and a cooler, wherein surface roughness of at least part of the dwindling (solidification) area of an inner surface of the nozzle of the nozzle is 3-5 Ra. By this nozzle assembly were solved disadvantages relating to depositing of various compounds of separating and/or filtering metals and/or alloying elements and/or oxygen on the inner surface of the nozzle of the nozzle assembly upwards of the point at which the cross-section of a continuously cast tube begins to dwindle because of casting contraction. Further, by this nozzle assembly was solved the problem occurred in the arrangements according to prior art that in the continuous casting the grain size of the internal structure has been excessive and thus the internal composition of the cast tube has been unfit for further shaping and also the disadvantages of known nozzle assemblies relating to excessive grain size were solved. Thus, by this nozzle assembly for continuous casting was achieved that smaller grain size of the internal structure of the cast tube is formed and thus further shaping properties of the tube is significantly improved and for example sanitary tubes, industrial tubes and even thin wall ACR-tubes from copper, alloyed copper and copper alloys such as for example OF Cu, DHP CU and CuNi or from other non-ferrous metals can be produced.

It is known from prior art that continuous upward vertical casting is typically used as the beginning stage of a process of producing a non-ferrous metallic tube. In these processes are first produced a cast tube by continuous upward vertical casting followed by cross area reduction drawing stage. In European patent application publication EP 2803423 A1 is disclosed a process for preparing a copper tube with specific properties and concentration for construction industry, which process consist of obtaining a pre-tube by continuous vertical casting, passing the pre-tube through a first tube drawing (wiredrawing) sector using paraffin as exterior lubricant and refrigerating agent, passing the pre-tube through a stress regulator, passing the pre-tube through a second tube drawing sector, accumulating the pre-tube obtained from the second tube drawing sector in a receiver that is inserted in baskets, inserting the pre-tube into the inlet guides of a furnace, purging the pre-tube with nitrogen, transferring the pre-tube to a chamber wherein a solvent is applied, introducing the pre-tube into a furnace at a speed less than or equal to 40 meters/minute, wherein heating is carried out using induction coils with a current intensity less than or equal to 50000 Amp, passing the pre-tube through a cooling chamber, and rolling of the tube obtained from the cooling chamber into a basket, wherein a protective wax is applied during the passage to the basket. In this known process the tube drawing is provided in the wiredrawing sector where a double wiredrawing process is carried out thanks to the joining and synchronization of two wiredrawing machines that are joined and synchronized and thus work in tandem.

In European patent application publication EP 2055795 A2 is disclosed a process, in which tube drawing is provided in drawing processing on an extruded base tube by using a plurality of drawing machines.

In tandem wiredrawing methods known from prior art the actual drawing is done in two to each other joined and synchronized stages, in which the drawing direction of the cast tube in each stage is the same. Due to this typically also intermediate stage of stress control is needed as the drawing in same direction in each other following drawing stages may accumulate stress deformation. Further, this drawing of the cast tube twice in the same direction in the drawing stages may decrease the quality in respect of excessive grain size after intermediate annealing, which then after further processing typically causes low surface quality of the tube as excessive grain size of the internal structure of the drawn tube easily causes unevenness to the surface of the produced tube.

SUMMARY OF THE INVENTION

An object of the invention is to create a process of producing a non-ferrous metallic tube, in which the problems and disadvantages of prior art have been eliminated or at least minimized.

An object of the invention is to create a process of producing a non-ferrous metallic tube, in which no stress control stage is needed in between the drawing stages.

An object of the invention is to create a process of producing a non-ferrous metallic tube, in which improved internal structure of the cast tube is achieved after the drawing stages and thus in which improved surface quality of the produced tube is achieved, even before the intermediate annealing.

Further an object of the invention is to create an improved process of producing a non-ferrous metallic tube.

In order to achieve the above objects and those that will come apparent later the process of producing a non-ferrous metallic tube according to the invention is mainly characterized by the features of claim 1. Advantageous embodiments and features are disclosed in the dependent claims.

According to the invention the process of producing a non-ferrous metallic tube comprises a casting stage, in which a cast tube having an outer diameter of 20-70 mm, preferably 35-55 mm and a wall thickness of 1.0-4.0 mm, preferably 2.0-3.0 mm, is cast from melt by continuous upward vertical casting process, and the casting stage is followed by at least two drawing stages, wherein in the drawing stages drawing direction of the cast tube in at least two each other following drawing stages is opposite to each other.

According to an advantageous feature of the invention the process has two to four drawing stages and the drawing direction of the cast tube in at least two drawing stages is opposite to each other.

According to an advantageous feature of the invention the process also comprises an intermediate annealing stage and a cooling stage.

According to an advantageous feature of the invention the process further comprises an uncoiling stage before each drawing stage and before the intermediate annealing stage and coiling stages after the casting stage, after each drawing stage and after the cooling stage.

According to an advantageous feature of the invention degree of reduction in cross-section area in the drawing stages before the intermediate annealing is 40-70%, preferably 50-60%.

According to an advantageous feature of the invention grain size of the cast tube after intermediate annealing stage of the process is 0.02-0.09 mm, for DHP Cu preferably at most 0.04 mm.

The process of producing a non-ferrous metallic tube according to the invention is very suitable in producing tubes of non-ferrous materials, for example of copper, oxygen-free copper, DHP copper, copper-nickel or copper-magnesium comprising materials. Especially suitable the process of producing a non-ferrous metallic tube according to the invention is in production of tubes, for example sanitary tubes, industrial tubes and even thin wall ACR-tubes, either plain or inner grooved, from copper, alloyed copper and copper alloys such as for example OF (oxygen-free) Cu (ASTM B170-99), DHP (deoxidized, oxygen-free with a residual phosphorus content) Cu (SFS-EN 1652) and CuNi or from other non-ferrous metals.

By the invention and its advantageous examples, a process of producing a non-ferrous metallic tube is achieved without problems relating to the internal structure of the cast tube after the drawing stages to opposite directions and the intermediate annealing and to the surface quality of the produced tube is achieved. By the invention and its advantageous examples, a process of producing a non-ferrous metallic tube is also achieved an improved process of producing a non-ferrous metallic tube, in which the process progresses smoothly and is easily controllable as no special synchronization is needed in the drawing stage and further no special stress control is needed. Especially, by the invention and its advantageous examples, a process of producing a non-ferrous metallic tube is achieved with improved internal structure of the cast tube after the drawing stages and the intermediate annealing, with improved strength as it is not so susceptible to cleavage fractures and with high surface quality of the produced tube. Further, by the invention and its advantageous examples cost effectiveness of the process of producing a non-ferrous metallic tube is improved, as well as, energy consumption of the process of producing a non-ferrous metallic tube is optimized. Additionally, an environmentally friendly process of producing a non-ferrous metallic tube is achieved.

In the following the invention is described in more detail with reference to the accompanying drawing, in which an advantageous example of the invention is presented in details of which the invention is not to be narrowly limited.

DETAILED DESCRIPTION OF THE INVENTION

Figure 1:
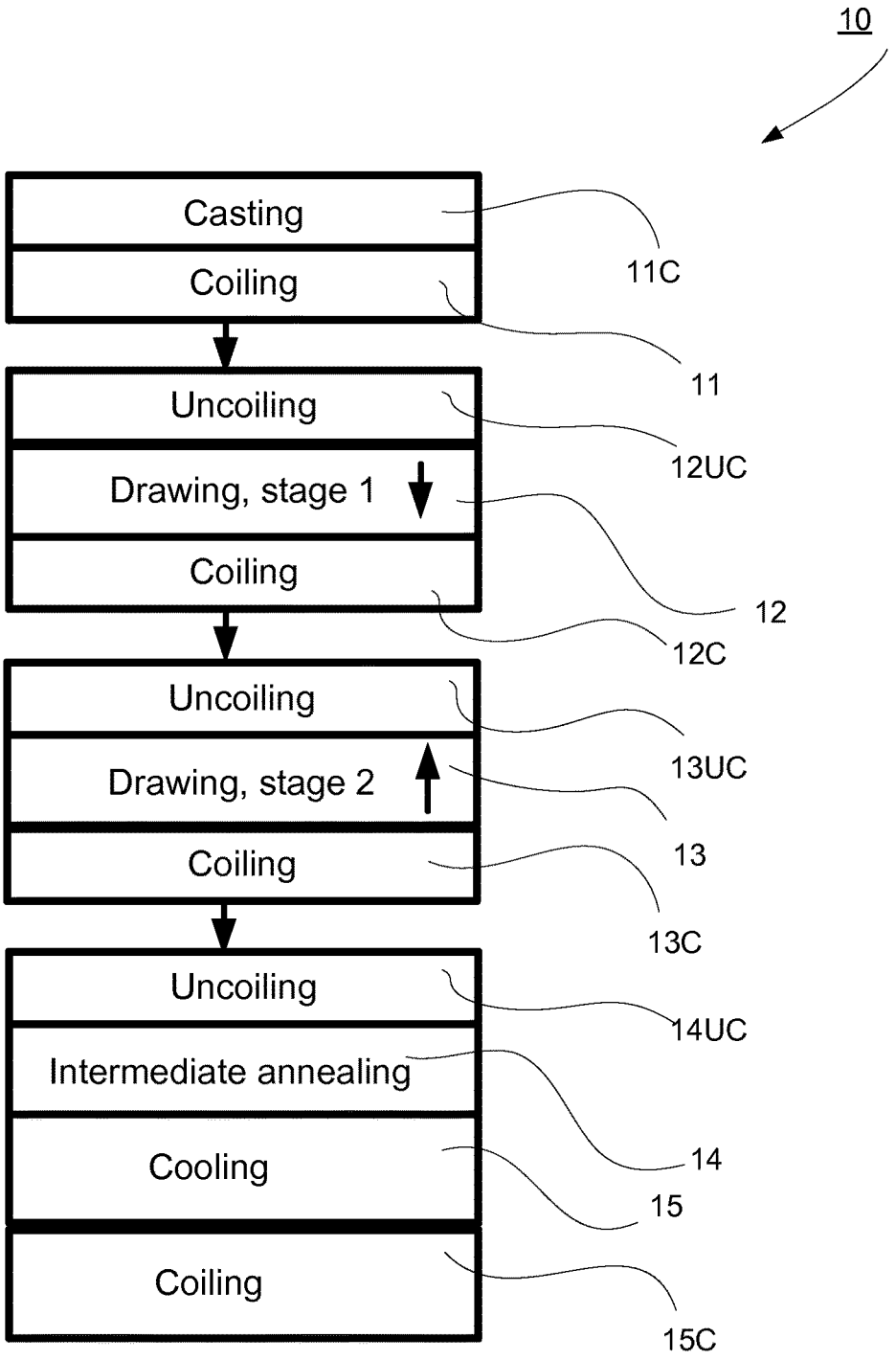
In FIG. 1 is schematically shown an advantageous example of the process of producing a non-ferrous metallic tube in accordance with the invention, In FIGS. 2A-2B is schematically shown an example of a drawing system suitable for the drawing stages of the process of producing a non-ferrous metallic tube in accordance with the invention and In FIGS. 3A-3B is schematically shown another example of a drawing system suitable for the drawing stages of the process of producing a non-ferrous metallic tube in accordance with the invention.

During the course of the following description relating to FIGS. 1-3B like numbers and signs will be used to identify like elements according to the different views which illustrate the invention and its advantageous examples. In the figures some repetitive reference signs have been omitted for clarity reasons.

In the example of FIG. 1 the process 10 of producing a non-ferrous metallic tube comprises main stages: casting 11, drawing—first stage 12, drawing—second stage 13, intermediate annealing 14 and cooling 15. Each of the main stages typically comprises corresponding coiling 11C, 12C, 13C, 15C and uncoiling stages 12UC, 13UC, 14UC. By the coiling and uncoiling stages any speed differences of the main stages in the process speed are evened out.

In the casting stage 11 a cast tube is cast from melt by upward continuous casting process followed by coiling 11C. Advantageously, in the casting a continuous casting nozzle assembly for upward vertical casting of a non-ferrous tube, which is suitable for uninterrupted casting, which nozzle assembly comprises a nozzle, a mandrel and a cooler, wherein surface roughness of at least part of the dwindling area of an inner surface of the nozzle is 3-5 Ra.

The drawing stage comprises two drawing stages to opposite directions: first drawing stage 12, in which the drawing is effected to the tube in one direction in its longitudinal direction, and second drawing stage 13, in which the drawing is effected to the tube in the opposite direction in view of the first drawing stage in its longitudinal direction. Before each of the drawing stages 12, 13 the tube is first uncoiled in corresponding uncoiling stage 12UC, 13UC and after each drawing stage 12, 13 the tube is coiled in the corresponding coiling stage 12C, 13C.

In the drawing stages 12, 13 advantageously a drawing system of examples in FIG. 2A-2B or 3A-3B is used. The drawing is done in at least two stages in which drawing direction of the cast tube in two each other following drawing stages 12, 13 is opposite to each other.

After the drawing stages intermediate annealing 14 and cooling 15 stages follow. Before the intermediate annealing stage 14 the tube is coiled in corresponding uncoiling stage 14UC and after the cooling stage 15 the tube is correspondingly coiled in a coiling stage 15C. In the intermediate annealing stage 14 the cast tube is heat-treated, annealed, in order to achieve the desired final microstructure to the tube material. In the cooling stage 15 the tube is cooled and there after coiled in the coiling stage 15C for transfer to next steps of treatment or use.

In FIGS. 2A-2B is shown an example of a drawing system suitable for the drawing stages 12, 13 of the process of producing a non-ferrous metallic tube. In this example is shown a left-handed system. The rotation direction of the coil in the uncoiling stage 12UC; 13UC and in the coiling stage 12C; 13C is indicated by arrows S and the drawing direction of the tube T is indicated by the arrows D12; D13. Before the first drawing in the first direction D12 in the first drawing stage 12 the tube T is first uncoiled in rotation direction S in the first uncoiling stage 12UC. Then, the tube T is drawn in the first direction D12 in the first drawing stage 12. After the drawing in the first drawing stage 12 the tube T is coiled in the first coiling stage 12C.The coil is then moved, as shown by the dashed line X, to the second uncoiling stage 13UC. The uncoiling in the second uncoiling stage 13C is begun from the tube end at the outer circumference of the coil. Then, the tube T is drawn in the second drawing stage 13 in the second direction D13, opposite to the first direction D12. After the drawing in the second drawing stage 13 the tube T is coiled in the second coiling stage 13C.

In FIGS. 3A-3B is shown another example of a drawing system suitable for the drawing stages 12, 13 of the process of producing a non-ferrous metallic tube. In this example is shown a right-handed system. The rotation direction of the coil in the uncoiling stage 12UC; 13UC and in the coiling stage 12C; 13C is indicated by arrows S and the drawing direction of the tube T is indicated by the arrows D12; D13. Before the first drawing in the first direction D12 in the first drawing stage 12 the tube T is first uncoiled in rotation direction S in the first uncoiling stage 12UC. Then, the tube T is drawn in the first direction D12 in the first drawing stage 12. After the drawing in the first drawing stage 12 the tube T is coiled in the first coiling stage 12C.The coil is then moved, as shown by the dashed line X, to the second uncoiling stage 13UC. The uncoiling in the second uncoiling stage 13C is begun from the tube end at the outer circumference of the coil. Then, the tube T is drawn in the second drawing stage 13 in the second direction D13, opposite to the first direction D12. After the drawing in the second drawing stage 13 the tube T is coiled in the second coiling stage 13C.

In the examples of FIGS. 2A-2B and 3A-3B of the drawing systems two drawing machines are used, one for each drawing stage 12;13. The drawing stages 12; 13 can also be done in one and the same drawing machine.

In the description in the foregoing, although some functions have been described with reference to certain features, those functions may be performable by other features whether described or not. Although features have been described with reference to certain embodiments or examples, those features may also be present in other embodiments or examples whether described or not.

Above only some advantageous examples of the inventions have been described to which examples the invention is not to be narrowly limited and many modifications and alterations of the details of the invention are possible within the scope of the following claims.

REFERENCE SIGNS USED IN THE DRAWING

10 process
11 casting stage
12 drawing stage 1
13 drawing stage 2
14 intermediate annealing stage
15 cooling stage
11C, 12C, 13C, 15C coiling stage
12UC, 13UC, 14UC uncoiling stage
D12, D13 drawing direction
T tube
S rotation direction

The invention claimed is:

1. A process of producing a non-ferrous metallic tube, the process comprising:

a casting stage, in which a cast tube having an outer diameter of 20-70 mm, is cast from melt by continuous upward vertical casting process; at least two drawing stages following the casting stage, wherein the cast tube cast from melt by the continuous upward vertical casting process has a wall thickness of 1.0-4.0 mm, and wherein drawing direction of the cast tube in the at least two drawing stages following each other is opposite to each other.

2. The process of producing the non-ferrous metallic tube according to claim 1, wherein the process has two to four drawing stages and the drawing direction of the cast tube in at least two drawing stages following each other is opposite to each other.

3. The process of producing the non-ferrous metallic tube according to claim 1, wherein the process comprises after the at least two drawing stages an intermediate annealing stage and a cooling stage.

4. The process of producing the non-ferrous metallic tube according to claim 3, wherein the process further comprises an uncoiling stage before each drawing stage and before the intermediate annealing stage and coiling stages after the casting stage, after each drawing stage and after the cooling stage.

5. The process of producing the non-ferrous metallic tube according to claim 3, wherein degree of reduction of cross-section area of the cast tube in the at least two drawing stages before the intermediate annealing is 40-70%.

6. The process of claim 5, wherein the reduction of the cross section area of the cast tube in the at least two drawing stages before the intermediate annealing is 50-60%.

7. The process of producing the non-ferrous metallic tube according to claim 3, wherein grain size of the cast tube after the intermediate annealing stage of the process is 0.02-0.09 mm.

8. The process of producing the non-ferrous metallic tube according to claim 3, wherein the process is to produce tubes, including ACR-tubes, either plain or inner grooved, from copper, copper alloys, or from other non-ferrous metals.

9. The process of producing the non-ferrous metallic tube according to claim 8, wherein grain size of the cast tube, which is made of DHP Cu, after the intermediate annealing stage of the process is at most 0.04 mm.

10. The process of producing the non-ferrous metallic tube according to claim 1, wherein the process is to produce tubes from copper, and copper alloys.

11. The process of producing the non-ferrous metallic tube according to claim 1, wherein the process is to produce tubes, including ACR-tubes, either plain or inner grooved, from copper, copper alloys, or from other non-ferrous metals.

12. The process of claim 1, wherein the cast tube has an outer diameter of 33-55 mm.

13. The process of claim 1, wherein the cast tube cast from the melt by the continuous upward vertical casting process has a wall thickness is 2.0-3.0 mm.

* * * * *